US009520652B2

(12) United States Patent
Samuel

(10) Patent No.: US 9,520,652 B2
(45) Date of Patent: Dec. 13, 2016

(54) WIDEBAND HIGH GAIN ANTENNA FOR MULTIBAND EMPLOYMENT

(71) Applicant: George Samuel, Grand Prairie, TX (US)

(72) Inventor: George Samuel, Grand Prairie, TX (US)

(73) Assignee: Mesh City Wireless, LLC, Grand Prairie, TX (US)

( * ) Notice: Subject to any disclaimer, the term of this patent is extended or adjusted under 35 U.S.C. 154(b) by 73 days.

(21) Appl. No.: 14/571,184

(22) Filed: Dec. 15, 2014

(65) Prior Publication Data

US 2015/0097739 A1 Apr. 9, 2015

Related U.S. Application Data

(63) Continuation-in-part of application No. 13/301,671, filed on Nov. 21, 2011, now Pat. No. 8,912,967, which is a continuation-in-part of application No. 12/419,213, filed on Apr. 6, 2009, now Pat. No. 8,063,841.

(60) Provisional application No. 61/075,296, filed on Jun. 24, 2008.

(51) Int. Cl.

| | |
|---|---|
| ***H01Q 1/24*** | (2006.01) |
| ***H01Q 13/18*** | (2006.01) |
| ***H01Q 1/52*** | (2006.01) |
| ***H01Q 13/08*** | (2006.01) |
| ***H01Q 21/00*** | (2006.01) |
| ***H01Q 21/06*** | (2006.01) |

(52) U.S. Cl.

CPC ..... *H01Q 13/18* (2013.01); *H01Q 1/243* (2013.01); *H01Q 1/246* (2013.01); *H01Q 1/523* (2013.01); *H01Q 13/085* (2013.01); *H01Q 21/0087* (2013.01); *H01Q 21/064* (2013.01)

(58) Field of Classification Search

CPC ..... H01Q 1/243; H01Q 1/246; H01Q 1/523; H01Q 5/0024; H01Q 13/085; H01Q 13/18; H01Q 21/0087; H01Q 21/064

USPC ..... 343/702

See application file for complete search history.

(56) References Cited

U.S. PATENT DOCUMENTS 5,541,611 A * 7/1996 Peng ..... H01Q 13/085 343/767

6,266,020 B1 * 7/2001 Chang ..... H01Q 1/243 343/702

* cited by examiner

*Primary Examiner* — Hoang V Nguyen

(74) *Attorney, Agent, or Firm* — Donn K. Harms

(57) ABSTRACT

An antenna element employable singularly or in an array and configured for concurrent RF transmission and receipt on a plurality of frequencies concurrently. The element is formed of conductive material on a substrate by a pair of substantially identical horns extending in opposite directions to distal tips. A cavity formed between the horns narrows to a narrowest point prior to curving. The element is capable of wideband RF communication on any frequency between a low frequency defined by the distance between the distal tips to a highest frequency defined by the narrowest point of the cavity. The antenna is especially well adapted for portable devices such as smartphones where concurrent cellular, Wi-Fi, and bluetooth communications may be accomplished with a single element. A dielectric planar substrate positioned between the antenna element and a tethered device is employable to reduce a spacing requirement therebetween.

5 Claims, 10 Drawing Sheets

WIDEBAND HIGH GAIN ANTENNA FOR MULTIBAND EMPLOYMENT

This application is a Continuation in Part application of U.S. patent application Ser. No. 13/301,671 filed on Nov. 21, 2011 which is a Continuation in Part application to U.S. patent application Ser. No. 12/419,213 filed on Apr. 6, 2009 and now issued as U.S. Pat. No. 8,063,841, which claims the benefit of U.S. Provisional Application Ser. No. 61/075,296, filed on Jun. 24, 2008, all of which are incorporated herein in their entirety by this reference thereto.

BACKGROUND OF THE INVENTION

1. Field of the Invention

The present invention relates to antennas for transmission and reception of radio frequency communications. More particularly, it relates to a device and method for positioning of a dielectric substrate between a motherboard for a cell phone or portable transceiver, and an antenna to optimize the received and transmitted frequencies through adjusting a thickness of the dielectric sheet.

2. Background

Since the inception of cellular telephones, cellular service providers have had the task of installing a plurality of antenna sites over a geographic area to establish cells for communication with cellular telephones located in the cell. From inception to the current mode of cellular broadcasting and reception providers have each installed their own plurality of large external cellular antennas for such cell sites. Generally, such antennas or cable hookup is necessary to provide a television receiver with the required signal strength to provide a perfect picture and sound to the viewer.

In practice, cell sites are grouped in areas of high population density with the most potential users. Because each cellular service provider has their own system, each such provider will normally have their own antenna sites spaced about a geographic area to form the cells in their respective system. In suburban areas the large dipole or mast type antennas must be placed within each cell. Such masts are commonly spaced 1-2 miles apart in suburban areas and in dense urban areas masts may be as close as ¼-½ mile apart.

Such antenna sites with large towers and large masts are generally considered eyesores by the public. Because each provider has their own system of cell sites and because each geographic area has a plurality of providers, antenna blight is a common problem in many urban and suburban areas.

The many different service providers employ many different technologies such as 3G, 4G, GSM, and CDMA. They also employ these technologies on bandwidths they either own or lease, and which are adapted to the technologies. Consequently, the different carriers tend to operate on different frequencies, and since conventional dipole and other cell antennas are large by conventional construction, even where the different providers are positioning sites near each other, they still have their own cell towers adapted to the length and configuration of the antennas they employ for their systems and which are adapted to their individual frequencies.

Since the many carriers and technologies employ different sized, large antennas, even if they wanted to share cell sites and antennas more often, the nature of the antennas used conventionally discourage it. The result being a plethora of antenna sites, some right next to each other, with large ungainly and unsightly antennas on large towers.

External antennas generally take the form of large cumbersome conic or Yagi type construction and are placed outdoors either on a pole on the roof top of the building housing the receiver or in an attic or the like of a building. These antennas are somewhat fragile as they are formed by the combination of a plurality of parts including reflectors and receiving elements formed of light weight aluminum tubing or the like having various lengths to satisfy the frequency requirements of the received signals and plastic insulators. The receiving elements are held in relative position by means of the insulators and the reflector elements are grounded together.

Assemblage of these antennas is required either by the user which may bend or break some of the elements during construction which must be replaced or become injured by falling or the like or by an installer for hire either of which increase the already high economic cost of the antenna.

Externally placed antennas of this type are continually subjected to the elements. Even if not damaged or destroyed by the elements during harsh weather conditions over time, these antennas will generally produce poor reception or reduced reception during extreme weather conditions or will gradually reduce their ability to produce acceptable reception over time due to mechanical decay. In addition to the above deficiencies, this type of receiving antenna is aesthetically ugly.

Further, the wide variance of radio frequencies which have evolved for communications standards such as cellular, Wi-Fi, and bluetooth, conventionally require specialized antennas for the transmission and receipt of each frequency. This is especially troublesome when dealing with a small communications device such as a smartphone which employs cellular frequencies over multiple bands, Wi-Fi as well as bluetooth. Thus, smartphones and laptop computers may have as many as three antennas or more, to allow communications using the various standards noted.

Other antennas that are currently employed widely worldwide, are indoor antennas which may be easy on the eyes, but unacceptable for producing a good picture and sound. The most common and effective of these indoor antennas is the well known dual dipole type positioned adjacent to or on the television receiver and affectionately referred to as "rabbit ears." These antennas are generally ineffective for fringe area reception and are only effective for strong local signal reception. When low frequency signals reception is desired, the dipoles must be extended to their maximum length which makes the "rabbit ear" antenna susceptible to tipping over or interfering with or causing possible damage to any adjacent objects.

Cable systems are also currently used for delivering signals to television receivers. This system is highly successful for delivering picture perfect signals to a television receiver over a large range of frequencies. One of the strongest disadvantages to the cable signal delivery systems is the economic cost of installation and the periodic cost of the signal delivery to the user which can run as high as one hundred dollars monthly.

Satellite dishes with their accompanying accessories are another of the present methods of receiving television signals. This method is popular and successful for receiving signals from fixed in position satellites. Systems of this type require large diameter dishes generally in excess of six feet and ideally about twelve feet for receiving acceptable signal levels. Small dishes under two feet in diameter are presently unusable for all but the most powerful satellite transmitters. The acceptable sized dishes are ugly to view and because of size are hard to hide from sight. In addition the systems as they exist today are quite expensive and, therefore, not available to all who desire to view picture perfect television reception.

There has not been a highly signal sensitive, visually attractive indoor television antenna until the emergence of the instant antenna.

The radiator elements are capable of concurrent communications between users and adjacent antenna nodes having the same radiator elements in one or a wide variety of bandwiths. The unique configuration of the individual antenna radiator elements provides excellent transmission and reception performance in a wide band of frequencies between 470 MHz to 5.8 GHz. Such performance in such a wide bandwidth is heretofore un-achieved and the single radiator element disclosed is capable of employment for reception and transmission in widely used civilian and military frequencies such as 700 MHz, 900 MHz, 2.4 GHz, 3.5 GHz, 3.65 GHz, 4.9 GHz, 5.1 GHz and 5.8 GHz. The radiator element actually has reasonable performance capabilities up to 1.2 gbps rendering it capable of deployment for antenna towers for concurrent reception and transmission of RF frequencies between 470 MHz to 5.8 GHz which is heretofore unachievably in a single antenna element. Such deployment will minimize the number of towers and antennas needed in a grid or communications web, yet provide for the maximum number of different types of communications from cellular phones to HDTV.

3. Prior Art

Conventionally, cellular, radio, and television antennas are formed in a structure that may be adjustable for frequency and gain by changing the formed structure elements. Shorter elements for higher frequencies, longer elements for lower, and pluralities of similarly configured shorter and longer elements to increase gain or steer the beam. However, the formed antenna structure or node itself, is generally fixed in position, but for elements which may be adjusted for length or angle to better transmit and receive on narrow bands of frequencies of choice in a location of choice to serve certain users of choice. Because many communications firms employ many different frequencies, many different such individual antenna towers are required with one or a plurality of such towers having radiator elements upon them to match the individual frequencies employed by the provider for different services such as Wi-Fi or cellular phones or police radios. This can result in multiple antenna towers, within yards of each other on hills or other high points servicing surrounding areas. Such duplication of effort is not only expensive, it tends to be an eyesore in the community.

Further, the conventional methods of electrically connecting the plurality of radiator elements within these towers similarly fall short. Typical power dividers/summers, employing transmission lines or wires are used to combine the incoming signals of the radiator elements to input into a central processor or the like. However, such typical methods fall short in accounting for electrical impedance, as well as the timing of the plurality of incoming signals. Such timing problems rise from unequal transmission line length or from placement of antenna elements in positions where signals arrive at different times. While modern receivers can be adapted to tune out and ignore such signals, this can decrease the signal strength to the device in need of it. As a result, along with the eyesore of having multiple antenna towers within yards of each other, transmitted and received signals, from separate antenna elements, may not be of the best quality.

As such, when constructing a communications array such as a cellular antenna grid, or a wireless communications web, the builder is faced with the dilemma of obtaining antennas that are customized by providers for the narrow frequency to be serviced. Most such antennas are custom made using radiator elements to match a narrow band of frequencies to be employed at the site which can vary widely depending on the network and venue. Also, a horizontal, vertical, or circular polarization scheme that may be desired to either increase bandwidth or connections. Further consideration must be given to the gain at the chosen frequency and thereafter the numbers of elements included in the final structure to meet the gain requirements and possible beam steering requirements.

However, such antennas once manufactured to specific individual frequencies or narrow frequency bands, offer little means of adjustment of their ultimate frequency range and their gain since they are general fixed in nature. Further, since they are custom manufactured to the frequency band, gain, polarization, beam width, and other requirements, should technology change or new frequencies become available, it can be a problem since new antennas are required to mach the changes. Additionally, as noted, there is little to no consideration as related to improvement with how the individual radiator elements are combined, and conventional methods continued to be employed.

Still further, for a communications system provider working on many different bands, with many frequencies, in differing wireless cellular or grid communications schemes, a great deal of inventory of the various antennas for the plurality of frequencies employed at the desired gains and polarization schemes must be maintained. Without stocking a large inventory of antennas, delays in installation can occur.

Such an inventory requirement increases costs tremendously as well as deployment lead time if the needed antenna configuration is not at hand. Further, during installation, it is hard to predict the final antenna construction configuration since in a given topography what works on paper may not work in the field. Additionally, what exact gain and polarization or frequency range which might be required for a given system, when it is being installed might not match predications. The result being that a delay will inherently occur where custom antennas must be manufactured for the user if they are not stocked.

This is especially true in cases where a wireless grid or web is being installed for wireless communications. The frequencies can vary widely depending on the type of wireless communications being implemented in the grid, such as cellular or Wi-Fi or digital communications for emergency services. The system requirements for gain and individually employed frequencies can also vary depending on the FCC and client's needs.

Still further, the infrastructure required for conventional cellular and radio and other antennas, requires that each antenna be hard-wired to the local communications grid. This not only severely limits the location of individual antenna nodes in such a grid, it substantially increases the costs since each antenna services a finite number of users and it must be hardwired to a local network on the ground.

A similar problem arises with the user of the various transmitted RF signals from these differing antenna sites, as well as from local transmission and reception sites for communications over Wi-Fi and bluetooth. The user of a device capable of receiving and transmitting over cellular, Wi-Fi, and bluetooth bands for instance, may have multiple antennas with each designed for a specific RF communication bandwidth and standard. This not only causes duplication and extra cost, but the placement of the different antennas on a small device such as a laptop computer or cellphone, must be precise in order not to cause interference from the adjacently placed antennas on the same device.

However, even employing the benefits afforded by the wideband antenna herein engaged to a cell phone or portable computer to increase gain of transmission and reception signals, a problem has been found during experimentation therewith. When the disclosed wideband antenna is employed in a cell phone application it is necessary to avoid placement of the antenna providing the increased gain, in proximity to electronic components and metal parts of the motherboard of the device itself. This distance is required in order to prevent electromagnetic interference with the radiated signal from the antenna from the components of the motherboard.

This spacing requirement imposes undesirable configuration restraints upon the cell phone manufacturer. This required separation between the antenna and the other electronic components and metal parts of the cell phone mother board and connected components, must be spaced a minimum of ½ the wavelength of the frequency(s) at which the cell phone is to operate. In the case of a smartphone operating at for example 1900 mhz, this spacing distance would be ½ the 15 cm wave distance or 7.5 cm. This would require a spacing of approximately 3 inches and in the world of compact and thin smartphones and pad computers, such is not possible.

Consequentially, when engaging a wideband antenna to a phone or other thin computing device, which can operate at a bandwith covered by the wide band antenna, there is an unmet need for an antenna positioning allowing for spacing proximate to the motherboard of the device, which is less than the required ½ wavelength at which the device operates.

Further, there is a continuing unmet need for an improved antenna radiator element and a method of antenna tower or node construction, allowing for easy formation and configuration of a radio antenna for two way communications such as cellular or radio for police or emergency services. Such a device would best be modular in nature and employ individual radiator elements which provide a very high potential for the as-needed configuration for frequency, polarization, gain, direction, steering and other factors desired, in an antenna grid servicing multiple but varying numbers of users over a day's time.

Such a device should employ a wideband radiator element allowing for a standardized number of base components adapted for engagement to mounting towers and the like. The components so assembled should provide electrical pathways to electrically communicate in a standardized connection to transceivers. Such a device should employ a single radiator element capable of providing for a wide range of different frequencies to be transmitted and received. Such a device, by using a plurality of individual radiator elements of substantially identical construction, should be switchable in order to increase or decease gain and steer the individual communications beams.

Employing a plurality of individual wideband radiator elements, such a device should enable the capability of forming antenna sites using a kit of individual radiator element components, each of which are easily engageable with the base components. These individual radiator element components should have electrical pathways which easily engage those of the base components of the formed antenna, to allow for a snap-together or other easy engagement to the base components hosting the radiator elements. Such a device should be capable of concurrently achieving a switchable electrical connection from each of the individual radiator elements, across the base components, and to the transceiver in communication with one or a plurality of the radiator elements.

Further, there exists a need for an antenna element which, while small enough to be employed in portable devices, such as smartphones and laptop computers, can provide excellent broadcast and reception signals to and from the device to a plurality of different transmission sites such as cellular towers, bluetooth receivers, and Wi-Fi enabled routers. Such an element should provide excellent reception and transmission using one or a plurality of operationally connected elements, to maximize transmission and reception capabilities while having a footprint on the device which is small. Such an element when employed should eliminate interference caused by multiple elements configured for individual transmission and reception bands and standards.

Additionally, such a radiator element device should be easily configurable to employ an improved means for combining the plurality of radiator elements into a transmission site, tower, or array, as well as a receiving device operating on a plurality of widely divergent RF frequencies. Combined in a plurality of such antenna elements, such a device should advantageously provide improved transmission characteristics as related to electrical impedance, as well as the timing of transmission and reception of combined RF signals to allow for increased gain rather than device negation of ill-timed signals.

SUMMARY OF THE INVENTION

The antenna element device and method of employment herein disclosed and described achieves the abovementioned goals through the provision of a single radiator antenna element which is uniquely shaped to provide excellent transmission and reception capability in a wideband of individual frequencies and communications standards between 470 MHz to 7 GHz.

In the range between 470-860 MHz, the radiator element disclosed provides excellent performance with a measured loss below −9.8 db which means that the Voltage Standing Wave Radio is 2:1 over this entire frequency band. In the 680 MHz to 2100 MHz band, the radiator element can concurrently provide excellent performance with a measured return loss of less than −9.8 dB. Similar concurrent performance characteristics are achieved in the bandwidth between 2.0 GHz to 6.0 Ghz.

Consequently, the disclosed single radiator element herein is capable of concurrent reception and transmission in multiple frequencies from 470 MHz to 5.8 GHz. It can be coupled and easily matched for inductance from an array coupling effect, and can provide the wideband communications reception and transmission needed for the 21$^{st}$ century. Further, it has a footprint which is small and therefore allows for employment as a single or multiple element array on devices such as smartphones, cell phones, and laptop computers. The same small footprint allows for positioning of multiple elements operatively engaged on transmission sites to allow for a phased array, or transmission and reception in multiple polarizations.

While employable in individual elements, the radiator element may also be coupled into arrays for added gain and beam steering. The arrays may be adapted for multiple configurations using software adapted to the task of switching between radiator elements to form or change the form of engaged arrays of such elements. Using radiator elements, each substantially identical to the other, and each capable of RF transmission and reception across a wide array of frequencies to form an array antenna, the device provides an elegantly simple solution to forming antennas which are highly customizable for frequency, gain, polarization, steering, and other factors, for that user.

The radiator element of the instant invention is based upon a planar antenna element formed by printed-circuit technology. The antenna is of two-dimensional construction forming what is known as a horn or notch antenna type. The element is formed on a dielectric substrate of materials such as MYLAR, fiberglass, REXLITE, polystyrene, polyamide, TEFLON, fiberglass or any other such dielectric material as would occur to those skilled in the art as suitable for the purpose intended. The substrate may be flexible whereby the antenna can be rolled up for storage and unrolled into a planar form for use. Or, in a particularly preferred mode of the device herein, it is formed on a substantially rigid substrate material in the planar configuration thereby allowing for components that both connect, and form the resulting rigid antenna structure.

The antenna radiator element itself, formed on the substrate, can be any suitable conductive material, as for example, aluminum, copper, silver, gold, platinum or any other electrical conductive material suitable for the transmission and reception purpose intended. The conductive material forming the element is adhered to the substrate by any known conventional technology.

In a particularly preferred embodiment, the antenna radiator element conductive material coating on a first side of the substrate is formed with a non-plated first cavity or covered surface area, in the form of a horn having two substantially identical nodes or leaves and having a decreasing gap or cavity is formed therebetween. The formed horn has the general appearance from a top plan view, of a cross-section of a "whale tail" with two substantially identical nodes, or tail half-sections, in a substantially mirrored configuration, extending from a center to pointed tips positioned a distance from each other at their respective distal ends. Optionally but preferred are two mirrored "L" shaped extensions. The extensions extend from the two opposing distal positioned tips on one end, to a second end engaging a lower portion of each node or leaf of the element. These extensions while optional, have been found to significantly enhance performance of the antenna radiator element at lower frequency ranges and would therefore be desirable where the element is to operate in the lower ranges.

The formed cavity is defined by the uncoated or unplated surface area upon the first side surface of the substrate between the two halves defined by the two nodes or leafs. This cavity forms a mouth of the antenna element and is substantially centered between the two distal tip points on each node or half-section of the tail shaped antenna radiator element. The cavity extends substantially perpendicular to a horizontal line running between the two distal tip points and then curves into the body portion of one of the tail halves and extends away from the other half.

Along the cavity pathway, from the distal tip points of the element halves, the cavity narrows slightly in its cross sectional area. The cavity is at a widest point between the two distal end points and narrows to a narrowest point. The cavity from this narrow point curves to extend to a distal end within the one tail half, where it makes a short right angled extension from the centerline of the curving cavity.

The widest point of the cavity between the distal end points of the radiator halves, determines the to low point for the frequency range of the element. The narrowest point of the cavity between the two halves determines the highest frequency to which the element is adapted for use. Currently, the widest distance is between 1.4 and 1.6 inches with 1.5812 inches being a particularly preferred widest distance. The narrowest point is between 0.024 and 0.026 inches with 0.0253 being particularly preferred when paired with the 1.5812 wide distance. Of course, those skilled in the art will realize that by adjusting the widest and narrowest distances of the formed cavity, the element may be adapted to other frequency ranges, and any antenna element which employs two substantially identical leaf portions to form a cavity therebetween with maximum and minimum widths is anticipated within the scope of the claimed device herein.

On the opposite surface of the substrate from the formed radiator element, a feedline extends from the area of the cavity intermediate the first and second halves of the radiator element and passes through the substrate to a tap position to electrically connect with the radiator element which has the cavity extending therein to the distal end perpendicular extension.

The location of the feedline connection, the size and shape of the two halves of the radiator element, and the cross-sectional area of the cavity, may be of the antenna designers choice for best results for a given use and frequency. However, because the disclosed radiator element performs so well and across such a wide bandwidth, the current mode of the radiator element as depicted herein, with the connection point shown, is especially preferred. Of course those skilled in the art will realize that the shape of the half-portions and size and shape of the cavity may be adjusted to increase gain in certain frequencies or for other reasons known to the skilled, and any and all such changes or alterations of the depicted radiator element as would occur to those skilled in the art upon reading this disclosure are anticipated within the scope of this invention.

The radiator element as depicted and described herein performs admirably across many frequencies and spectrums employed by individuals, government, and industry, and is as such a breakthrough in antenna element design. Currently, performance is shown by testing to excel in a range of frequencies including but not limited to lower frequency ranges of 700 MHz and 900 MHz, and higher frequency ranges of 2.4 GHz, 3.5 GHz, 3.65 GHz, 4.9 GHz, 5.1 GHz, 5.8 GHz, and 7 GHZ with bandwidth capabilities up to 1.2 gbps. Such a wide range in the RF spectrum from a single radiator element is unheard of prior to this disclosure.

Because of this unique shape rendering the radiator element adept at transmitting and receiving across many frequencies, each such radiator element is easily combined with others of identical shape, to increase gain and steer the beam of the formed antenna.

To that end, in employing a plurality of the disclosed radiator elements to form an array antenna, the device employs a plurality of base or vertical board members each of which are configured with electrical pathways terminating at connector points to provide electrical communication between one or a plurality of the engageable antenna radiator elements, and wired connectors communicating with a transmitter, receiver, or transceiver.

The disclosed electrical pathways of the present invention communicating between the individual radiator elements and a connector provide a means for combining the incoming signals of two or more elements. In general, each pathway is so configured to provide identical length electrical paths from each radiator element to the connector. Further, the pathway varies in width (i.e. surface area of the conductive material) as the signals of at least two elements are combined. The novel aspects of the pathway as described in more detail later provides improvements in the aspects of electrical impedance matching and signal timing.

One or a plurality of the vertical board members arranged in parallel, are adapted to engage slits in the substrate of the radiator element to thereby provide registered points of engagement for the electrical connection with horizontal substrate members on which antenna radiator elements are formed and positioned. The vertical board members may also have antenna radiator elements positioned thereon generally on a side surface opposite the side surface of the electrical pathways or on a layer insulated from the pathways.

In the modular kit of components, the vertical or baseboard members would be adapted to engage a mount which registers the terminals of the electrical pathways in an electrical engagement to conductors communicating with the transmission and reception equipment. At the other end of the electrical pathways are connection points that engage with antenna radiator elements on the base member or might be placed to register in engagement with pathways leading to the antenna elements, on horizontal board members.

Engagement of the elements on their respective substrates is accomplished by slits in the vertical board members sized to engage with notches in the horizontal board members providing the mount for the horizontally disposed radiator elements of the antennas. Engaging the slits with the notches will automatically align the horizontal board members carrying the antenna radiator elements into an array with connection points on the secondary base members or with the electrical pathways on the vertical board members.

The horizontal board members may have antennas formed or engaged thereon which are adapted to virtually any frequency desired by the user. However, because as noted, the disclosed radiator element provides such strong two-way communications across such a large spectrum, such is preferred over conventionally formed radiator elements. Thus, a kit of horizontal board members, each with the disclosed radiator elements mounted thereon, being inherently dimensioned for operation at different frequencies, will allow a user to assemble the modular parts into a large array antenna adaptable to the frequency desired from the spectrum made available by the radiator elements unique construction and form.

The horizontal radiator elements engaged to the base members have slits at a projecting rear portion which provide a connection point to an element connection. The secondary board members having electrical pathways thereon, have mating connection points such that engaging the secondary board with the horizontal substrate will connect all of the horizontal antenna radiator elements to connectors leading to the radio equipment. The secondary boards by changing the paths of the electrical pathways formed thereon, can engage the elements in combination with the transceiver or can provide isolation of each element and a connection to the transceiver. Pathway changes may be physical for permanent changes or by switching means placed along the conductors and controlled by a computer or user.

Antenna radiator elements formed on the vertical or base member substrate when engaged to a tower in an array in a generally vertical position will provide for vertical polarization while the antenna radiator elements engaged to the horizontal board member substrate in an array will provide for horizontal polarization. Employing both horizontal and vertical radiator elements in the same frequency with appropriate electrical pathways to each other and to the transceiver may provide for a circular polarization to be achieved.

Or broadcast and reception of signals on the same or different frequencies can be achieved by assembling horizontal board members with antennas adapted to one or more frequencies with the vertical board members having antennas dimensioned to operate at one or more other frequencies.

The resulting formed antenna array structure which resembles a sorting box is thus highly customizable to the task at hand by simply choosing horizontal and vertical board members having antenna radiator elements thereon adapted to the frequency needed. Because all the parts are adapted to engage and connect the antennas to electrical pathways communicating with the transmission and broadcast equipment, installation to a standardized mount of the vertical board members will allow for easy installation and adjustment in the field for users.

Gain may be increased or decreased by the parallel or independent connections between adjacent horizontal and vertical disposed antenna radiator elements on the respective horizontal and/or vertical substrates forming board members. Combining two vertically disposed antenna radiator elements on different board members into a larger array will increase the gain, and adding a third or fourth will increase it more. This can be done easily by switching or connecters which engage or separate the pathways leading from the antenna radiator elements to the transmission and reception equipment.

Steering of the beamwidth of the formed antenna array of individual radiator elements may be adjusted in the same manner using switch engaged horizontal and vertically disposed radiator elements to achieve the ground pattern in either a horizontal, vertical, or circular polarization. Electronic switching by computer would be the best current mode to insure maximum gain and preferred steerability by the formed antenna array. Junction points of the pathways on the horizontal board members to the pathways on the secondary base members may thus be joined, for increasing gain, or provided as separate pathways to the transceiver with the same or different elements to increase the number of frequencies available or to reduce gain.

When formed in a series of adjacent rectangular cavities steering of the beam is possible in the same fashion by joining or separating antenna radiator elements to pathways leading to transmission equipment.

Using the disclosed radiator element herein, singularly or in an array such as in the disclosed modular kit herein, yields highly customizable antennas which may be literally manufactured in the field from an inventory of horizontal and vertical board members with differing numbers of antenna radiator elements, which are carried in a vehicle.

In yet another preferred mode, singular or at least two radiator elements may be employed by an engagement directly to a mobile phone, smart phone, mobile tv device, or similar small electronic device. Using one or a plurality of the elements provides substantially improved reception and transmission qualities in the cellular, Wi-Fi, and bluetooth bands from a single antenna element.

Further, experimentation has shown a substantial improvement in signal strength and reduction in dropped calls in so called "holes" or low signal areas. The radiator element of the present invention may be retrofitted to an existing electrical device by integration or replacement of the typical pigtail or band antenna, or can be manufactured by the OEM with the mobile phone or other device. The employment of the element herein provides a single element with exceptional transmission and reception capabilities for numerous bands such as cellular, Wi-Fi, and bluetooth. Additionally, by employing a plurality of individual radiator elements operationally engaged, the electronic device can be configured with improved reception in multiple polarizations, wherein the electronic device's software may be used for signal differentiation.

When employing the wideband antenna herein engaged to a cell phone, smartphone, or portable computing device which required RF transmissions, it has been found during experimentation with different antennas engaged to differing devices requiring RF transmissions to operate, that the required ½ wavelength spacing between the electronic components and the antenna is not practical in small devices like smartphones and pad computers. Such a spacing would render the devices to a thickness that is unacceptable in modern cell phones and thin pad computers.

It has been found that placement of an appropriate dielectric substrate, in between the wideband antenna, and the motherboard and electronic components of the phone or computing device, can solve this spacing dilemma by allowing a more proximate positioning of the wideband antenna to the device to which it is coupled. Further, when working with a wideband antenna capable of frequencies outside the scope of those employed by the device to which it is tethered, it has been found that changing a thickness of the deictic substrate, and allow the antenna to be tuned or matched to the frequencies employed by the tethered device thereby increasing gain for those desired frequencies within the range of the wideband antenna. Thus, a device is provided employing a wideband antenna as herein described as well as a method for antenna matching to optimize gain for the frequencies used by the tethered phone or device.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the pioneering conception of such a radiator element formed on a substrate and with a cavity between two halves to yield a wide RF band coverage, and used singularly or in combination in the kit-like component method to form an array, upon which this disclosure is based, may readily be utilized as a basis for designing of other antenna structures, methods and systems for carrying out the several purposes of the present disclosed device. It is important, therefore, that the claims be regarded as including such equivalent construction and methodology insofar as they do not depart from the spirit and scope of the present invention.

It is one principal object of this invention to provide an antenna radiator element which transmits and receives radio waves across a wide array of frequencies, in a single element, and therefore eliminates the need for multiple or other differently shaped or lengthened elements.

It is an object of this invention to provide an antenna that may be constructed in an array of individual elements formed in modular components to yield transmission and reception frequencies which are highly customizable by engaging kits of antenna elements.

It is an additional object of this invention to provide such a modular antenna wherein the gain may be increased or decreased by combining or separating adjacent respective horizontal and vertically disposed antenna elements.

It is an additional object of this invention to provide an antenna element engageable to a portable device such as a smartphone, which provides excellent transmission and reception capability across multiple bands employing multiple communications standards.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF DRAWING FIGURES

FIG. 1 depicts a top plan view of the preferred mode of the radiator element herein shaped similarly to a "whale tail" positioned on a substrate showing the distal points forming the widest point of the cavity "W" which narrows to a narrowest point "N" at a position substantially equidistant between the two distal points.

FIG. 1*a* depicts the antenna element of FIG. 1, without the "L" shaped extension.

FIG. 2 depicts a rear side of the planar substrate on which the radiator element is mounted showing the feedline engaging a half portion of the radiator element at a tap.

FIG. 2*b* depicts the rear of the device of FIG. 1*a*.

DETAILED DESCRIPTION OF THE PREFERRED EMBODIMENTS OF THE INVENTION

Figure 1:
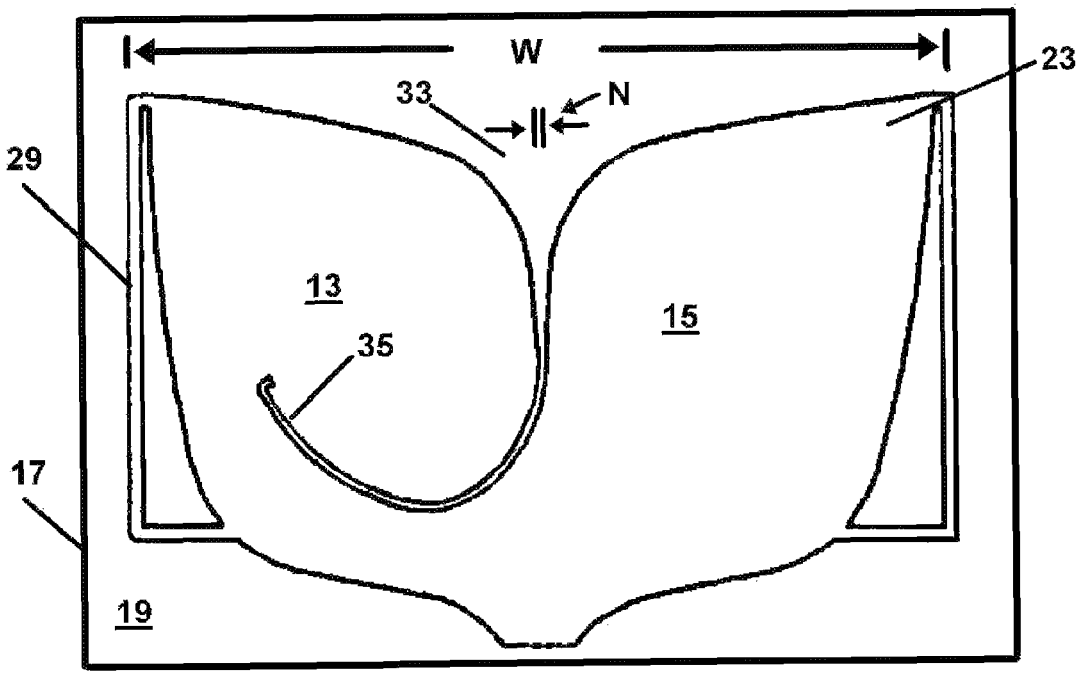
Figure 2:
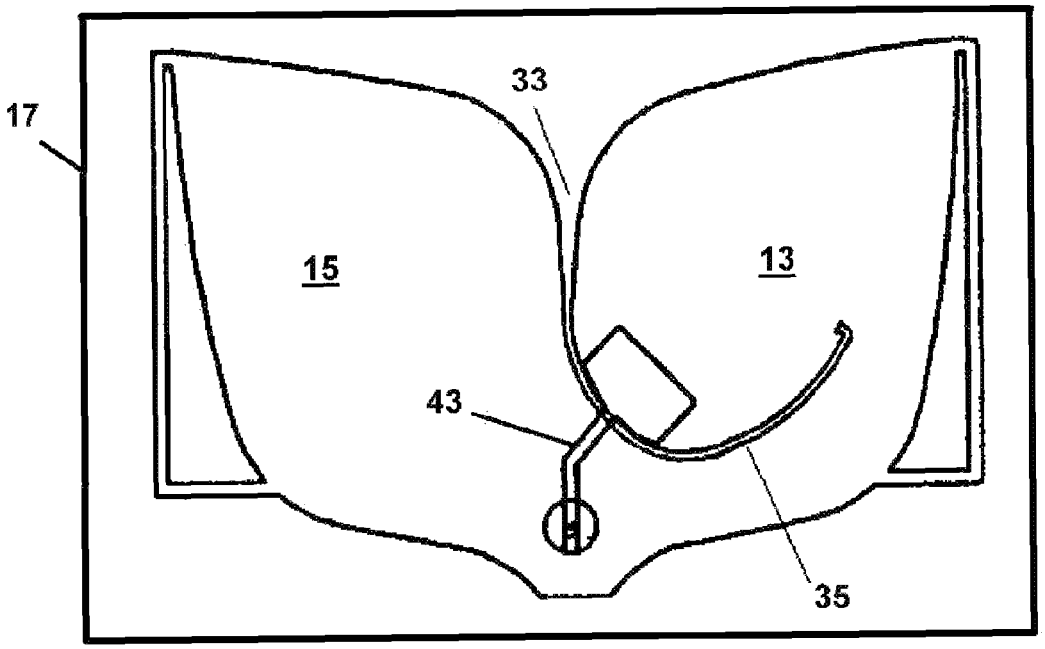

Referring now to the drawings of FIGS. 1-18, in FIGS. 1 and 2, depicting the radiator element 22 of the device 10, the radiator element 22 shaped much like a "whale tail" is depicted having two halves which are formed by a first horn 13 and second horn 15 looking much like leaves and being substantially identical or mirror images of each other. Each radiator element 22 of the invention is formed on a substrate 17 which as noted is non conductive and may be constructed of either a rigid or flexible material such as, MYLAR, fiberglass, REXLITE, polystyrene, polyamide, TEFLON fiberglass, or any other such material which would be suitable for the purpose intended.

Figure 1A:
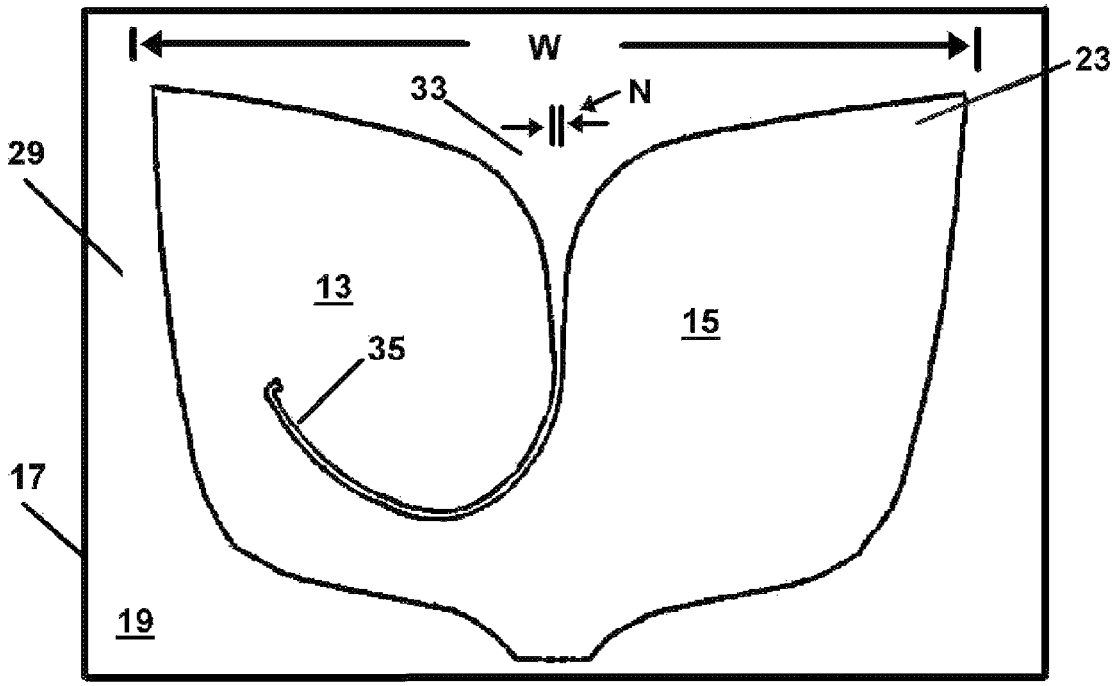
Figure 2B:
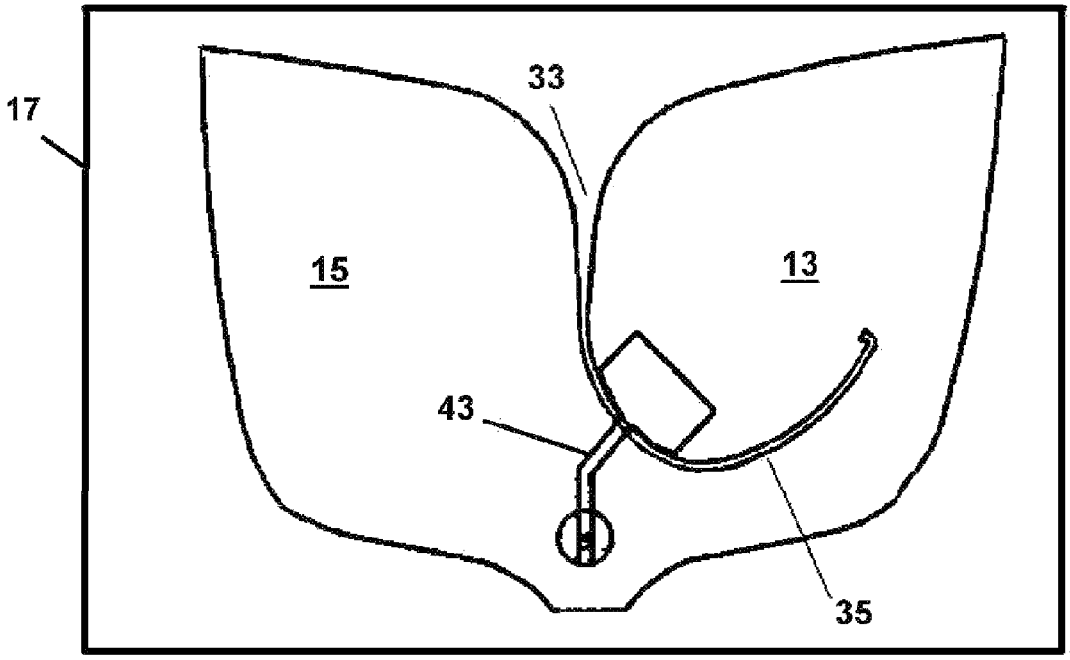
Figure 3:
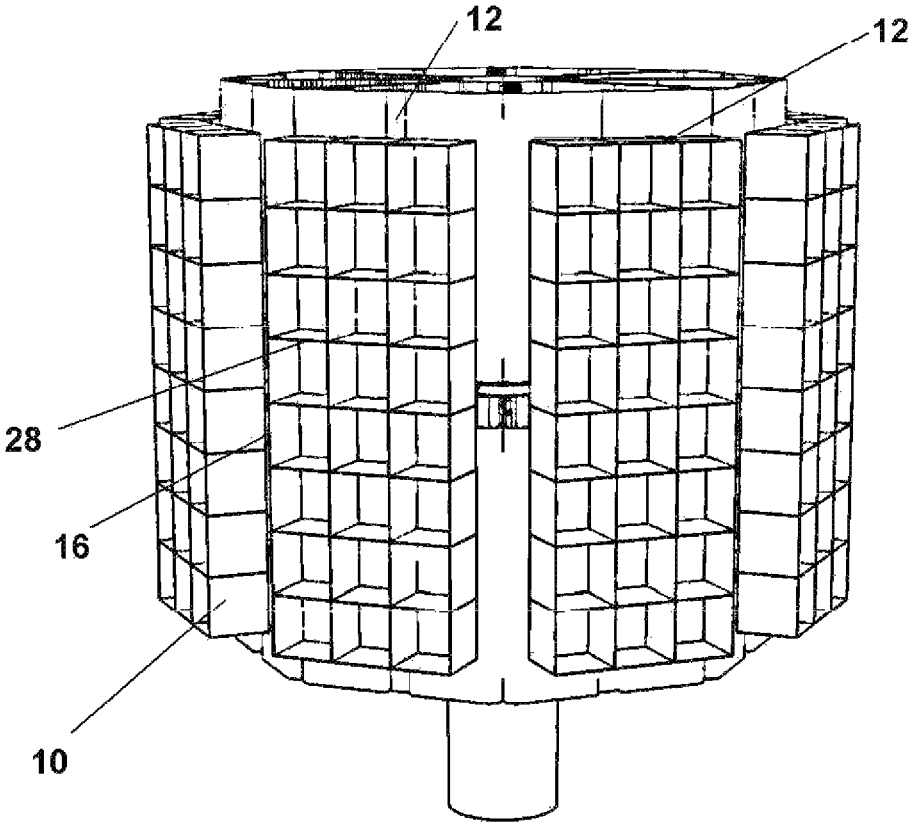
FIG. 3 depicts a tower having arrays of the radiator elements for increased gain, polarization, and beam steering.

A first surface 19 is coated with a conductive material by microstripline or the like or other metal and substrate construction well known in this art. Any means for affixing the conductive material to the substrate is acceptable to practice this invention. The conductive material 23 as for example, include but are not limited to aluminum, copper, silver, gold, platinum or any other electrical conductive material which is suitable for the purpose intended. As shown in FIG. 1 the surface conductive material 23 on first surface 19 is etched away, removed by suitable means, or left uncoated in the coating process to form the first and second horns and having a mouth 33 leading to a curvilineal cavity 35. Optionally but preferred mirrored "L" shaped extensions 29 extend from those tips 31 to a connection at the lower points of respective horns 13 and 15. The extensions 29 have been found to significantly enhance performance of the antenna radiator element device 10 at lower frequency ranges of the noted frequencies above. FIGS. 1*a* and 2*b* show the device 10 which provides substantial improvement over conventional antenna elements even without the extensions 29 thereon.

The cavity 35 extending from the mouth 33 has a widest point "W" and extends between the curved side edges of the two horns 13 and 15 to a narrowest point "N" which is substantially equidistant between the two distal tips 31 and which is positioned along an imaginary line substantially perpendicular to the line depicting the widest point "W" running between the two distal tips 31 on the two horns 13 and 15.

The widest distance "W" of the mouth 33 portion of the cavity 35 running between the distal end points 21 of the radiator halves or horns 13 and 15, determines the low point for the frequency range of the device 10. The narrowest distance "N" of the mouth 33 portion of the cavity 35 between the two horns 13 and 15 determines the highest frequency to which the device 10 is adapted for use. Currently, the widest distance "W" is between 1.4 and 1.6 inches with 1.5812 inches being a particularly preferred widest distance "W". The narrowest distance "N" is between 0.024 and 0.026 inches with 0.0253 being particularly preferred when paired with the 1.5812 widest distance "W". Of course those skilled in the art will realize that by adjusting the widest and narrowest distances of the formed cavity, the element may be adapted to other frequency ranges, and any antenna element which employs two substantially identical leaf portions to form a cavity therebetween with maximum and minimum widths is anticipated within the scope of the claimed device herein.

The cavity 35 proximate to the narrowest distance "N" then curves into the body portion of the first horn 13 and extends away from the other horn 15. The cavity 35 extends to a distal end 37 within the first horn 13 where it makes a short right angled extension 41 away from the centerline of the curving cavity 35 and toward the centerline of the mouth 33. This short angled extension 41 has shown improvement in gain for some of the frequencies.

On the opposite surface of the substrate 17 shown in FIG. 2, a feedline 43 extends from the area of the cavity 35 intermediate the two horns 13 and 15 forming the two halves of the radiator element 22 and passes through the substrate 17 to electrically connect to the first horn 13 adjacent to the edge of the curved portion of the cavity 35 past the narrowest distance "N".

The location of the feedline 43 connection, the size and shape of the two horns 13 and 15, of the radiator element 22, and the cross-sectional area of the widest distance "W" and narrowest distance "N" of the cavity 35, may be of the antenna designers choice for best results for a given use and frequency. However, because the disclosed radiator element 22 performs so well and across such a wide bandwidth, the current mode of the radiator element 22 as depicted herein, with the connection point shown, is especially preferred.

The radiator element 22 maintaining substantially the same "whale tail" appearance when viewed from above, may be adapted in dimension to optimize it for other RF frequencies between a maximum low frequency and maximum high frequence and those that fall therebetween. This may be done by forming said lobes 13 and 15 to position the distal tips 31 at a widest point "W", which is substantially one quarter or one half the distance of the length of an RF wave radiating at the maximum low frequency desired. To determine the maximum high frequency for the radiator element 22, it would be formed with a narrowest point "N" of the mouth having a distance which is substantially one half or one quarter the distance of the length of the RF wave radiating at the highest frequency desired. This may be done by adjusting the curved edges of the lobes 12 and 15 slightly to accommodate the narrower or wider narrowest point "N". Once so formed, the radiator element 22 will receive and transmit well on all frequencies between the maximum high and low frequencies.

Because of this unique shape providing the radiator element 22, and concurrent transmit and receiving ability across many frequencies, each such radiator element 22 is easily combined with others of identical shape, to form an array to increase gain and steer the beam of the formed antenna. Using switching means run by software adapted to the task, the connected radiator elements 22 may function in a horizontal polarization, vertical polarization, or circular polarization and may be joined, or employed separately to communicate with other such radiator elements 22 remote antennas formed in the same fashion.

As noted, the device 10 may be employed in a modular fashion as in FIGS. 4-10, by forming the radiator elements 22 on substrates 17 which form base members 16 and secondary base members 17, each of which are configured with electrical pathways 18 terminating at connector points 20 to communicate between the engageable antenna radiator elements 22, and a transmitter, receiver, or transceiver.

One or a plurality of the base members 16 and secondary base members 17 are arranged in parallel and provide slots 24 as a means for frictional connection with the traverse horizontal board members 28 on which antennas or antenna radiator elements are positioned. The base members 16 may also have antenna radiator elements 22 positioned thereon.

The slots 24 in the base members 16 and the secondary base members 17 are sized to engage with notches 34 in the horizontal board members 28. Engaging the slots 24 with the notches 34 will automatically align the horizontal board members 28 carrying the antenna radiator elements 22 with the connector points 36 on the secondary base members 17 engaging the radiator elements 22 with the electrical pathways 18 on the secondary base members 17. The horizontal board members 28 may have antenna radiator elements 22 formed or engaged thereon.

The secondary board members having electrical pathways 18 thereon leading to mating connection points 36 at the notches 34 such that engaging the secondary base member 17 can connect all of the horizontal antenna radiator elements 22 to the connectors 20 leading to the radio equipment individually, or combined depending on the formation of the pathways 18 and number of terminating connectors 20.

Thus gain may be increased by pathways combining radiator elements 22 or, frequency numbers may be increased by providing pathways 18 that provide separate communications of individual radiator elements 22 to a transceiver. The device may be formed into an array of vertically disposed radiator elements 22 and/or horizontally disposed radiator elements 22 to increase gain or use a horizontal, vertical, or circular polarization scheme. A ground plane 40 on a substrate, is provided in such an array formation also having slots therein, to allow communication of the horizontal board members 18 through 20 the ground plane 40 and a rear connection of the secondary base members 17 to the aligned notches 34.

Figure 4:
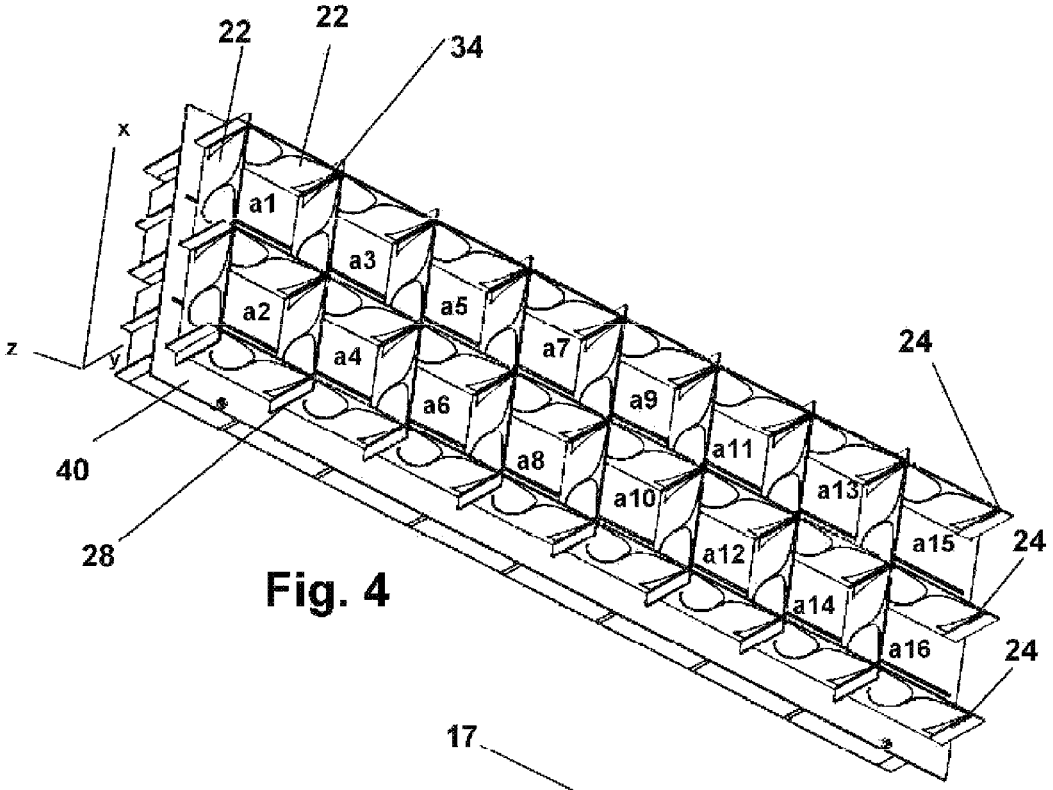
FIG. 4 depicts a modular array antenna formed of the elements herein showing the rectangular cavities having antenna elements therein in horizontal and vertical dispositions.
Figure 5:
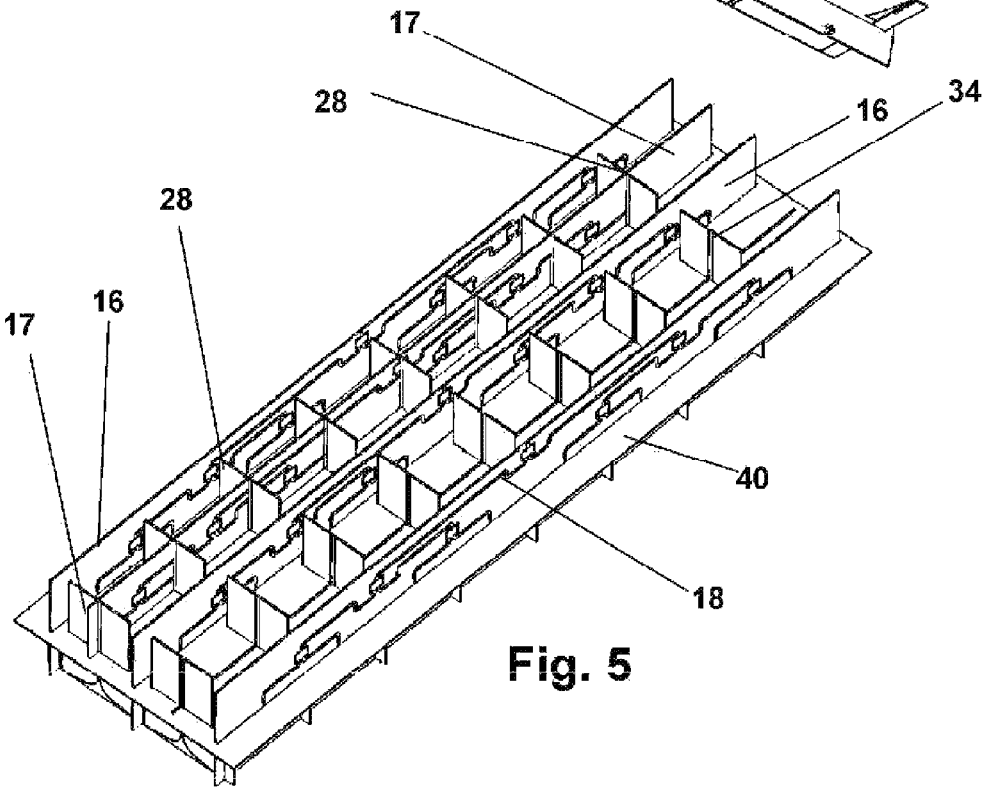
FIG. 5 is a rear perspective view of FIG. 4 showing the pathways on the base members adapted to engage traverse or horizontal members.
Figure 6:
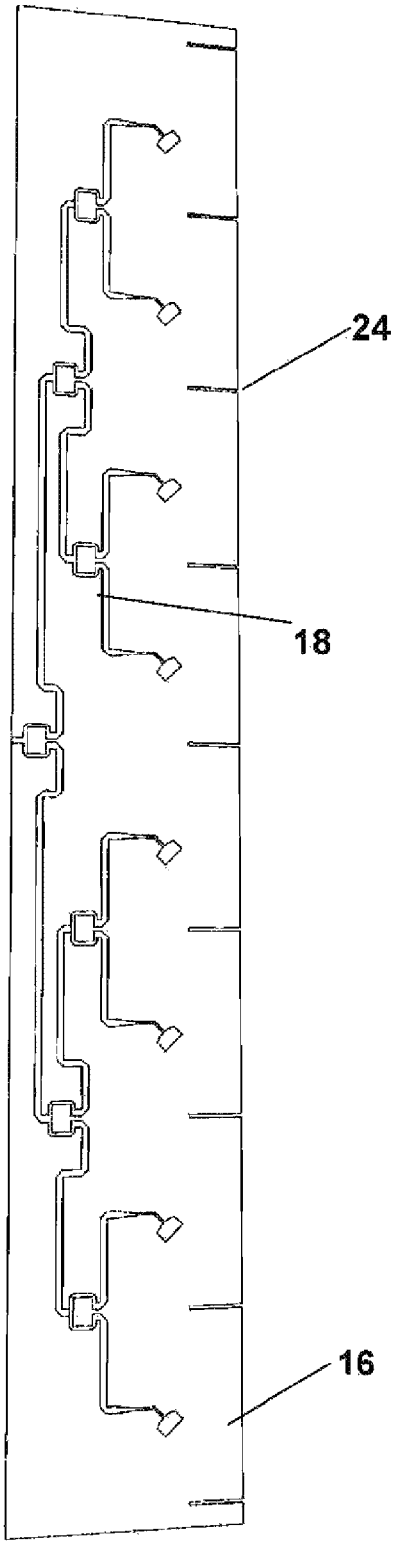
FIG. 6 shows the rear of the device in FIG. 7 and the electrical pathways formed on the substrate communicating with taps to the antenna elements on the opposite side.
Figure 7:
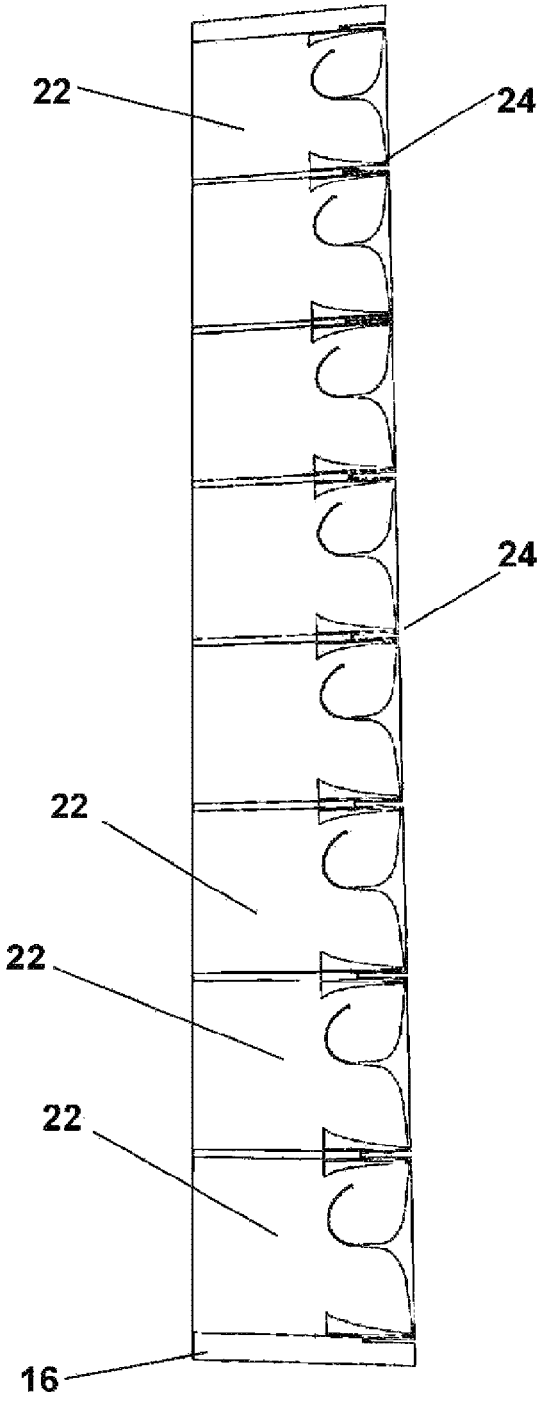
FIG. 7 depicts a base member of FIG. 6 with a plurality of individual antenna elements formed thereon.
Figure 8:
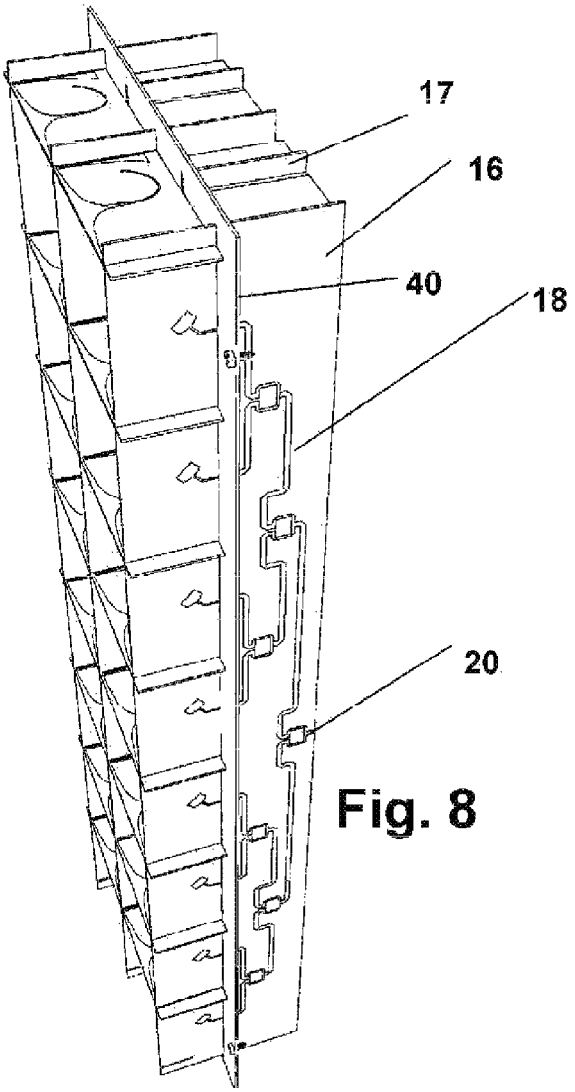
FIG. 8 shows a side view of the device of FIGS. 4-5 and the pathways formed thereon to communicate between antenna elements and transceivers, receivers, or other components.
Figure 9:
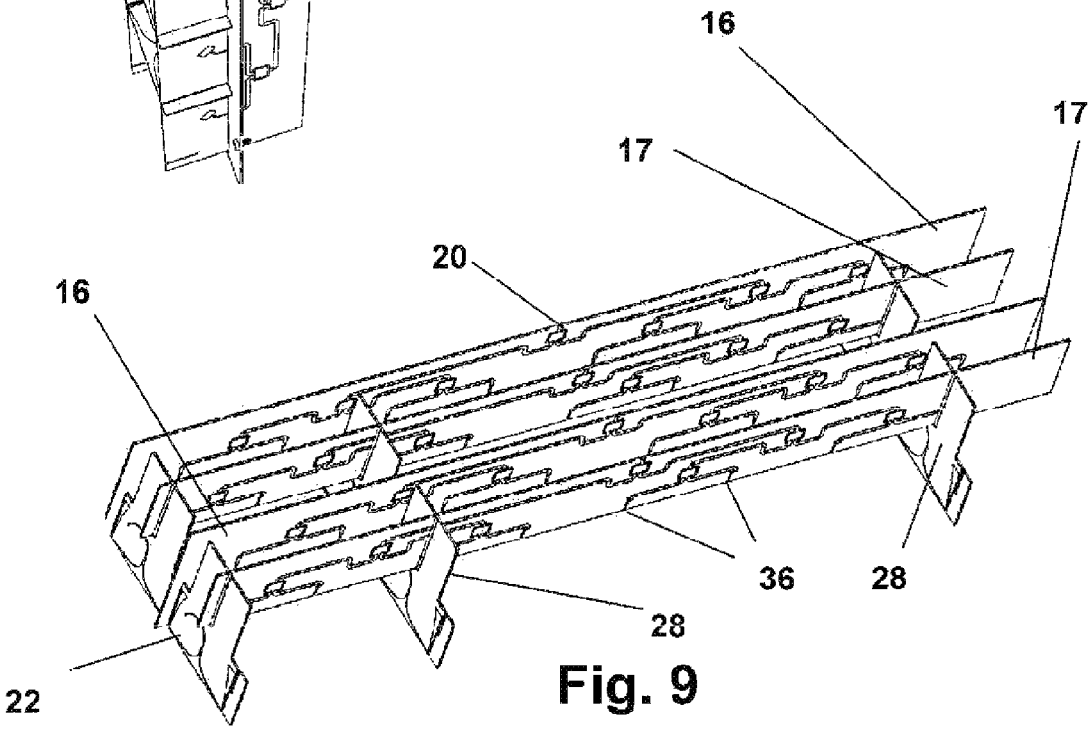
FIG. 9 depicts the device wherein the horizontal members are being engaged with the vertical or base members in a registered engagement enabling frictional or other electrical coupling of electrical pathways easily.

The formed array antenna of individual radiator elements 22 will resemble a sorting bin and have a plurality of adjacent rectangular cavities such as shown in FIG. 4 where the employment of pathways 18 on the base members 16 and secondary members 18 to combine adjacent parallel radiator elements 22 such as those in AI-A2, will yield increased gain, and increasing power to the horizontally disposed radiator elements 22 allows for angle changes A-B shown in FIG. 1 for the transmission and reception beam.

Of course the connections noted herein as being frictional can be hard wired, or otherwise wired and electrically connected as needed and in some cases this may be preferable. Switching means to combine or separate individual radiator elements 22 to increase or decrease the array gain, or to increase individual transmission pathways between like radiator elements 22 on other towers, would best be handled electronically by a computer and software monitoring system needs based on users within range of the tower housing the antennas formed of the radiator elements 22.

Those skilled in the art will realize that such switching will allow each radiator element 22 to be combined with others for increased gain or to be separated to decrease gain. Beam steering may also be changed and the radiator elements 22 may be separated to yield individual horizontal or vertically disposed RF pathways for the transceiver to allow for more individual frequencies and transmission carriers from each such antenna array formed of the switchably engageable array of radiator elements 22 in the differing horizontal and vertical arrangements.

When employed with such software controlled electronic switching in towers of such radiator elements 22 forming antennas in a grid, the device thus forms a phased array antenna configuration providing concurrent multiple band high capacity communications between towers in the grid and users on the ground. Concurrently, the antenna provides for a steering of beam width and angles to users on the ground to form optimal tower-footprint for communications in a grid.

Figure 10:
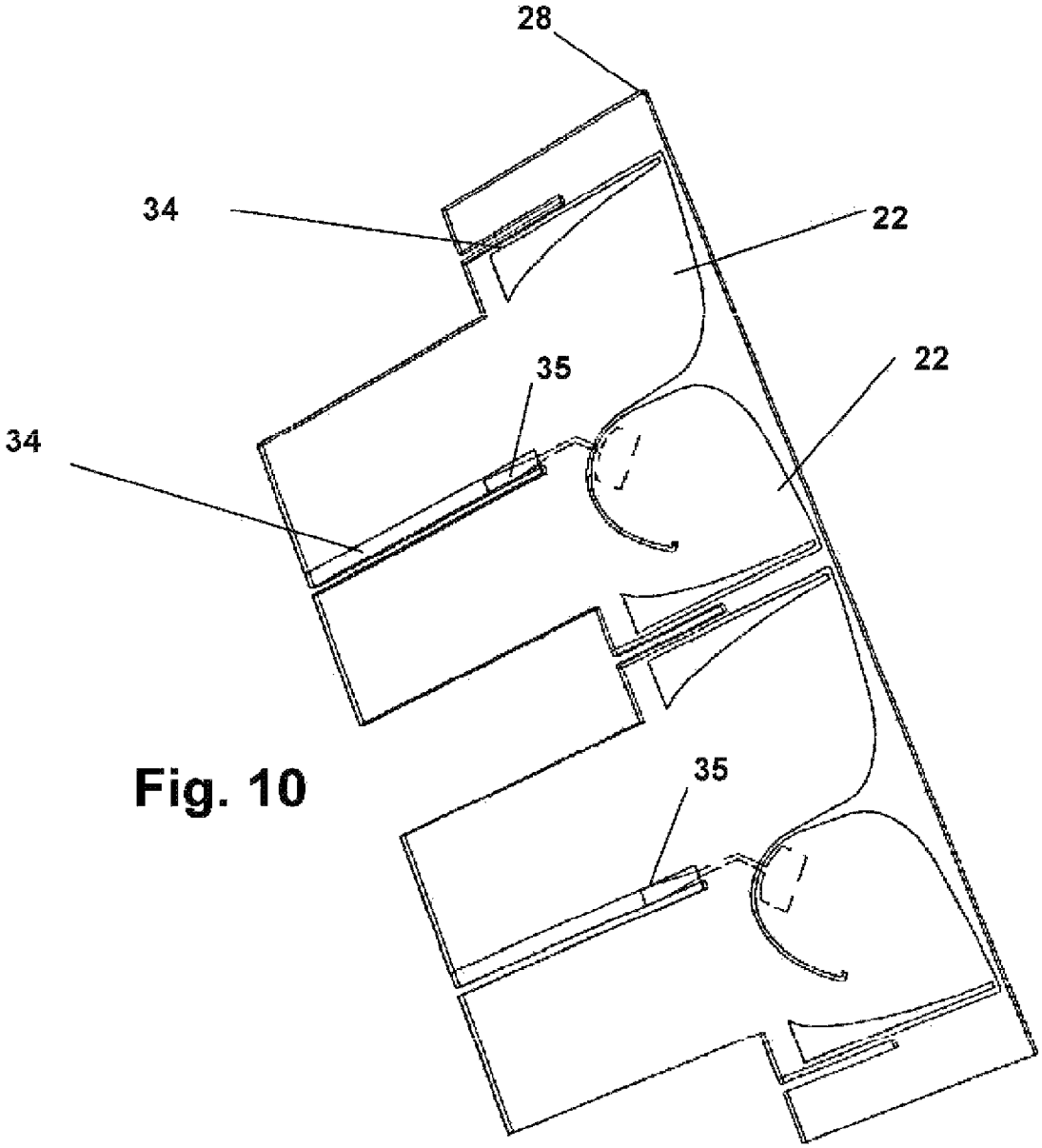
FIG. 10 depicts a horizontal member with adapted to engage slots in the vertical members and the disclosed particularly preferred "whale tail" element configuration.
Figure 11:
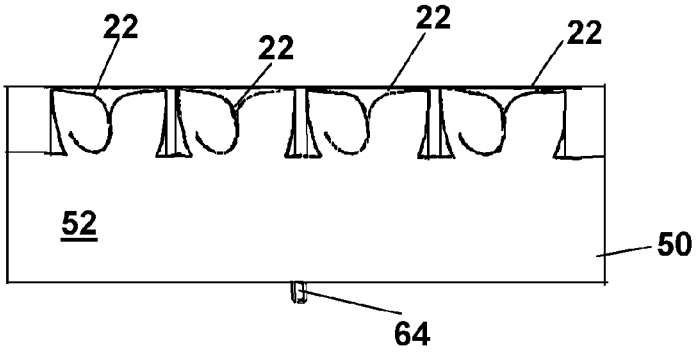
FIG. 11 depicts a rectangular substrate with a plurality of individual antenna elements formed thereon.

FIG. 10 shows a rectangular member 50 such as a base member shown previously depicting a plurality of radiator elements 22 formed or engaged on the first surface 52. Shown currently employing four such radiator elements 22, there can be seen in FIG. 11, a rear view of the rectangular member 50 showing the second surface 54 having individual feedlines 43 corresponding to the radiator elements 22 on the first surface 52. Also shown is a particularly preferred mode of the electrical pathway 18 connecting the feedlines 43 to a connector 64. The present invention provides a novel pathway 18 for connecting and combining a plurality of antenna elements 22 to a common port or connector 64. In the current mode, the pathway 18 provides improved means for impedance matching as well as signal timing.

As mentioned, the feedlines 43 and pathway 18 are formed of printed circuit technology where conductive material is printed, or formed by removal of surrounding conductive material, or otherwise engaged to a nonconductive dielectric substrate to form the pathway 18. Impedance matching and signal timing characteristics have been found to be greatly improved with the current preferred mode of the pathway 18 shown in the figures. Briefly, these characteristics are tuned due to varying the width, and therefore the overall surface area of portions of the pathway, as well as providing identical feedline to connector lengths for each radiator element 22.

Figure 12:
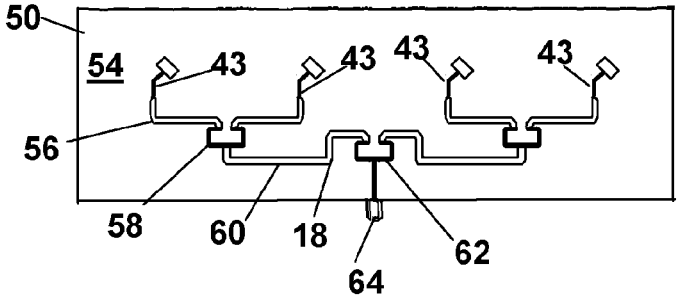
FIG. 12 depicts the rear view of FIG. 11 showing the particularly preferred electrical pathways formed on the substrate communicating with taps to the antenna elements on the opposite side.

As can be seen in FIG. 12, the pathway 18 begins with a substantially wide first strip 56 of conductive material directly connected to the feedline 43. In the current mode, the pathway 18 employs a plurality of 2-1 power dividers/summers. The first wide strip 56 extends and connects to a substantially thinner or narrower pathway strip 58 where the signals of the two adjacent elements 22 are combined. The thinner strip 58 as this junction provides a means to tune and adjust the timing of the incoming signals of the adjacent elements 22 as well as aids in proper impedance matching as is often desired with electrical systems.

The pathway 18 continues with a second substantially wider strip portion 60 extending from the previous summer 58 to yet an additional 2-1 summer 62, also having a substantially thinner strip of conductive material. As can be clearly seen, the first wide strip 58 communicating with each respective feedline 43 is identical in length and surface area. Further, the additional substantially wide strip 60 communicating with both pairs of radiator elements 22 are similarly identical in length and surface area. Further, the summer/divider portions 58, 60 are substantially identical as well.

An advantage of the current preferred mode of the pathway 18 is to provide identical length paths for each radiator element 22 and feedline 43 therefrom. This provides substantially identical timing of the incoming and broadcast signals to and from each radiator element 22. It must be noted that those skilled in the art may immediately recognize that the configuration of the preferred pathway 18 may be employed with more then 4 elements, and such is anticipated. Further, it is within the scope of the invention that the novel electrical pathway disclosed may be employed with any number of the radiator or antenna elements as needed to combine incoming signals or the like, and is not limited to the radiator elements 22 of the present invention alone.

Figure 13:
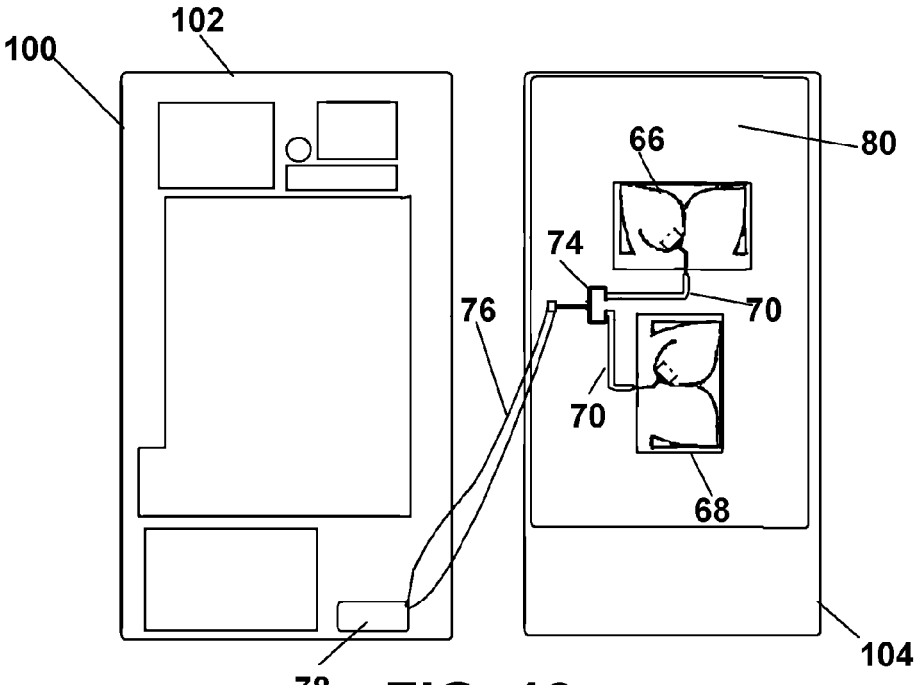
FIG. 13 shows an additional preferred mode of two individual radiator elements disposed in both vertical and horizontal orientation employed as an antenna of an electronic device, such as a smart phone, and using the preferred electrical pathway.

There is seen in FIG. 13, a view of a particularly preferred mode of the radiator element 22 and preferred pathway 18 of the present invention. There is shown a transmitting and receiving electronic device 100, such as a cell phone, smartphone, tablet, mobile TV device, or the like, with operatively engaged first 66 and second 68 radiator elements. In this mode the electronic device 100 is provided with the improved reception and transmission characteristics of the novel radiator element 22 of the present invention. As noted, the element 22 will concurrently transmit and receive across a plurality of frequencies and standards including cellular, Wi-Fi, and bluetooth thereby eliminating the need for multiple antennas.

The electronic device 100 is shown in parts depicting a first half 102 and a second half 104, with the first half 102 shown housing the majority of electronic components associated with the device 100. As is shown, a first wideband radiator element 66 is positioned horizontally while the second element 68 is positioned vertically, with the elements 66, 68 combined using the preferred wide strips 70 and substantially thin strip power divider/summer 74. The summer 74 is then wired 76 to the transceiver unit 78 of the electronic device.

In this configuration the radiator elements 66, 68 provide a plurality of phased antennas for the device 100 replacing the antennas conventionally employed with such a device 100. In the case of a cell phone or smartphone 100, since the majority of cellular service is provided in vertical polarization, the horizontal and vertical dispositions of the elements 66, 68 will allow the electronic device 100 to receive signals no matter what orientation the device 100 is held in by the user. This applies to concurrent reception of cellular frequencies, local Wi-Fi frequencies, and bluetooth frequencies with the transceiver 78 used to differentiate the signals. For example, with the phone 100 positioned upright, the second element 68 will receive the vertical polarized signals, and if the phone 100 is positioned on its side (if a user is laying down), the first element 66 will better receive the vertical polarized signal. The transceiver can be configured and/or programmed to choose the best signal at any given moment.

Figure 14:
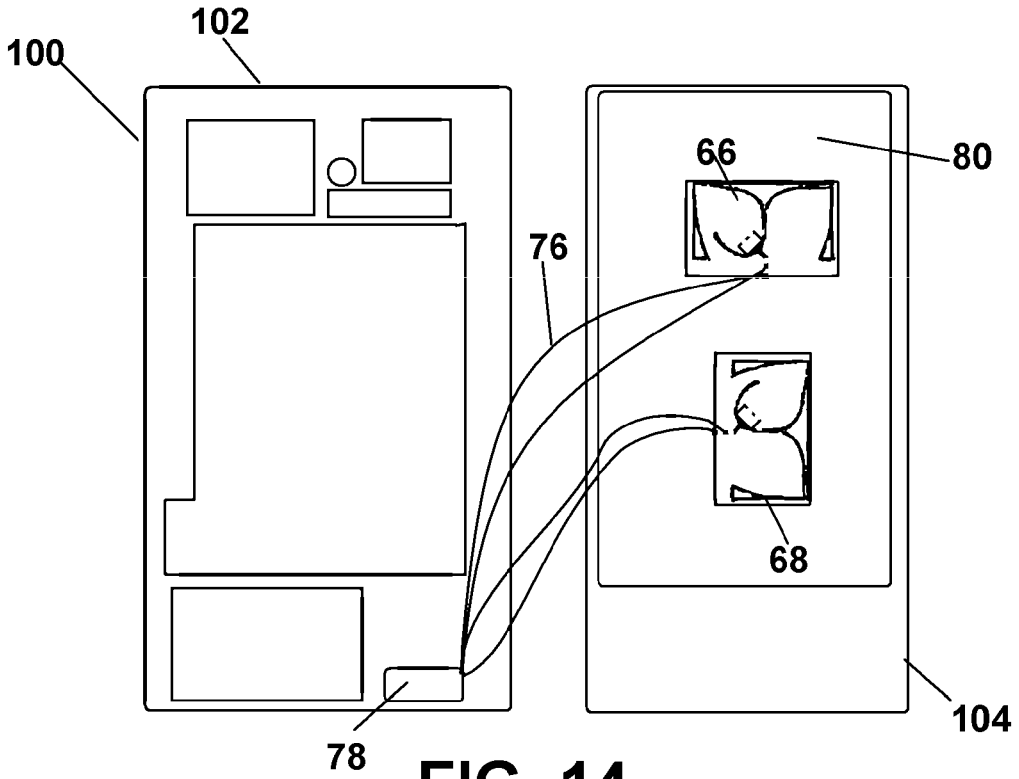
FIG. 14 shows yet another preferred mode of employment of two individual radiator elements depicting having separate transmission lines.

In yet another preferred mode shown in FIG. 14, a first element 66 and second element 68 are separately wired 76 to the transceiver unit 78 of the electronic device 100. This mode may be preferred where the first element 66 can transmit and receive on a horizontal polarization, while the second element 68 can transmit/receive in the vertical polarization, with the signals differentiated by distinct and separate wiring 76. For example the first element 66 may be employed for bluetooth and wifi, while the second element 68 is employed for cellular calls.

Figure 15:
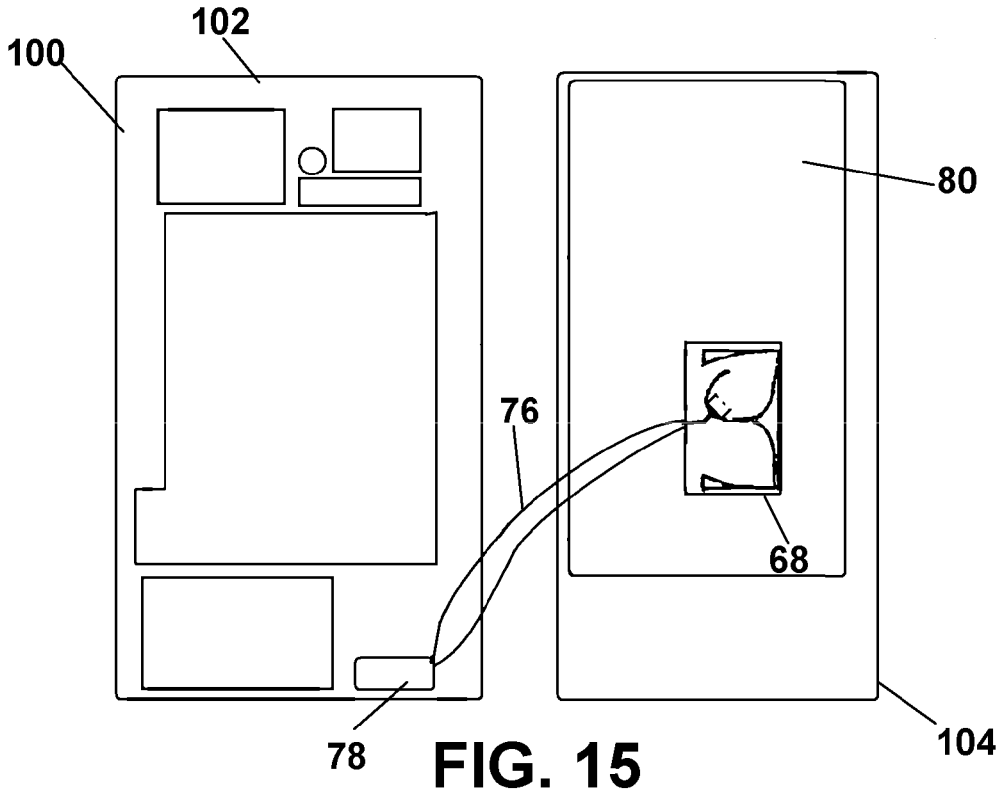
FIG. 15 shows still another preferred mode of the device employed with an electronic device, however with only a single radiator element acting as an antenna.

FIG. 15, shows yet another mode of the device, wherein a single radiator element 68 is wired 76 to the electronic device 100 and thereby providing a transmission and reception antenna.

In all preferred modes of employment of the radiator element shown in FIGS. 13-15, there may additionally be included a ground plane 80 located between the radiator elements 66, 68 and back half 104 of the electronic device 100. This will provide a means to electrically shield the radiator elements from the user when in use should such be of concern.

Figure 16:
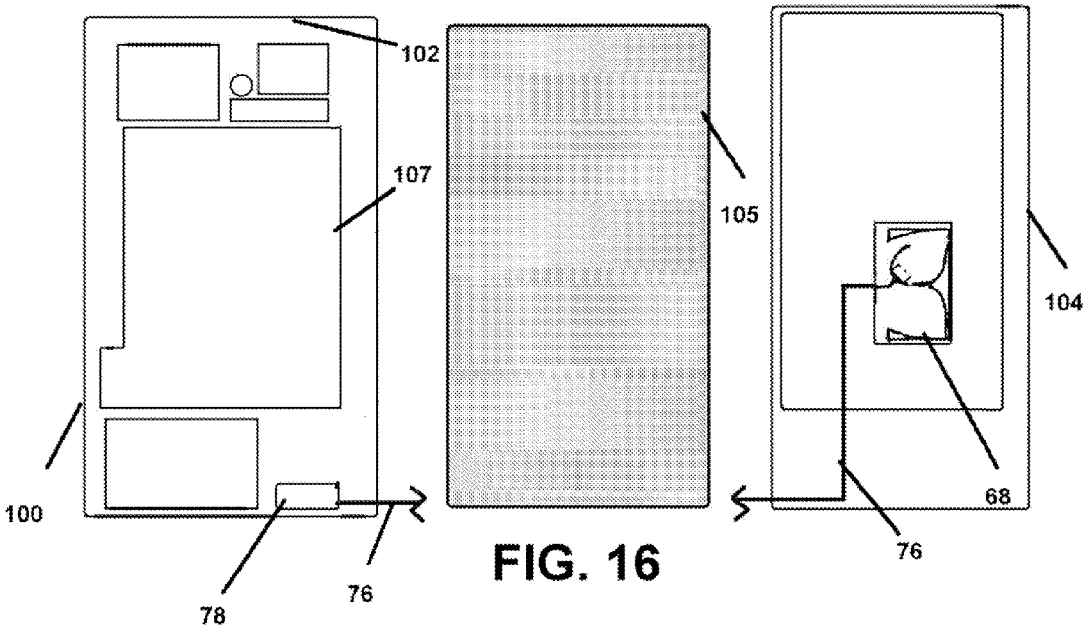
FIG. 16 depicts a configuration of the antenna device herein to a tethered cell phone or pad computer, which allows closer placement by employment of a dielectric substrate.
Figure 17:
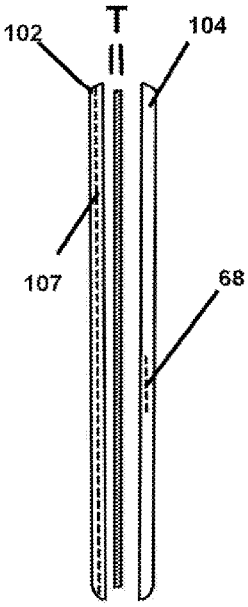
FIG. 17 is a side view of the configuration of FIG. 16 showing the dielectric substrate of a thickness "T" placed in-between the antenna and electronic components for tuning.
Figure 18:
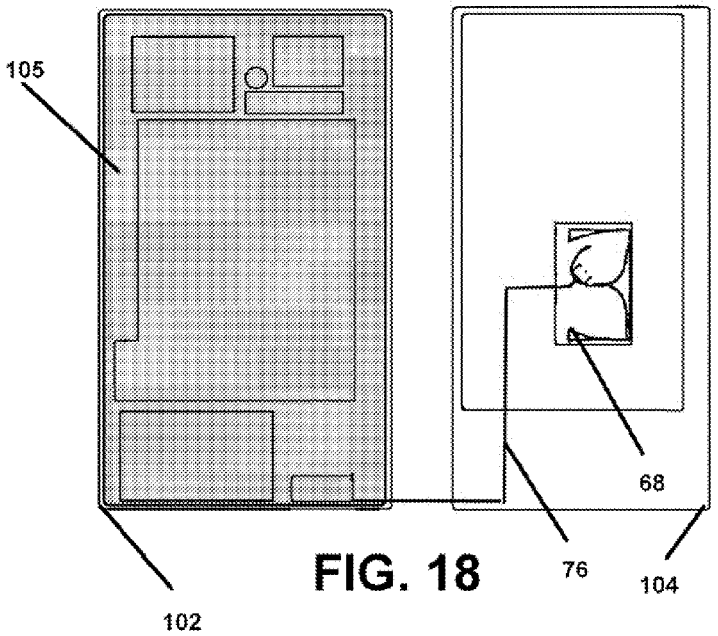
FIG. 18 shows the device of FIG. 16 with the dielectric substrate placed adjacent the electronics of the phone or pad computer or device tethered to a wideband antenna.

Shown in FIG. 16-18 is a configuration of the device herein, using a dielectric substrate 105 which has through experimentation been found to alleviate the need for spacing the wideband radiator element 68 at a length distant from the electronics or motherboard 101, of least the length of the bandwith at which the tethered phone or other device 100 is to operate.

The dielectric substrate 105 can consist of any material possessing dielectric properties which currently include those from a group including MYLAR, fiberglass, silicone, ceramic materials, and FR-4. The dielectric substrate 105 in operative engagement with the phone or other device 100 is positioned inside the cell phone between the cell phone motherboard 107 and the wideband antenna radiator element 68 which is located in the second half 104 of the device 100 or nearest the rear cover.

As noted the radiator element 68 is capable of operating over a wide range of frequencies, including all frequencies presently in use by mobile telecommunications carriers, as well as frequencies not employed for cell phones, smartphones, and similar devices using a network provided by a telecommunications carrier.

In addition to eliminating the wavelength spacing of the radiator element 68 from the electronics such as on the motherboard 107, the inclusion of the planar dielectric substrate 105 can also be employed in a method and device to optimize the efficiency of the device 100 tethered to the radiator element which as noted will receive frequencies not employed by the device 100 such as a cell phone or smart phone.

Increased gain can be provided to increase efficiency by employing the dielectric substrate 105 of a thickness "T" and formed of a material which optimizes the frequencies of the engaged radiator element 68 communicated to the device 100.

It has been found that placing the dielectric substrate 105 in-between the radiator element 68 and motherboard 107 and electronics engaged therewith, can be achieved by varying the thickness "T" of the dielectric substrate 105 to create the desired Yz wavelength separation between the wideband radiator element 68 and the cell phone components/metal parts, depending upon the specific frequencies of the range provided by the radiator element, intended to be optimized.

For example FR-4 has a Dielectric constant permittivity 4.34 @ 1 GHz. It has been found that using a planar dielectric substrate 105 of a thickness "T" between 1/64" to 3/16" in a configuration of the dielectric substrate 150 yields excellent results when positioned between a wideband radiator element 68 capable of receiving and transmitting RF outside the scope of the 1700 Mhz to 2100 Mhz on which a tethered phone device 100 operates. Currently a FR-4 material dielectric substrate 105 of a thickness "T" of 1/16", has yielded the best result and has remedied the above noted spacing requirements of radiator element 68 to motherboard 107.

In a method, the thickness "T" of the dielectric substrate 105 positioned between the radiator element 68 and electronics on the motherboard 107 is adjusted thicker for dielectric substrate material having a lower dielectric constant of permittivity than that noted above for FR-4, and is adjusted to render "T" thinner for material having a higher dielectric constant permittivity than that noted above. In all modes where a dielectric substrate 105 is employed as noted herein, the radiator element 68 can be placed immediately adjacent one side of the dielectric substrate 105, and spaced from the electronics on the motherboard 107 the distance of the thickness "T" of the dielectric substrate 105.

While all of the fundamental characteristics and features of the imposed radiator element and modular assembly thereof, and the positioning of a dielectric substrate between the radiator element and a tethered device have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. An antenna element system for engagement with an electronic device, comprising:

an antenna substrate;

a wideband antenna element formed on a first surface of said antenna substrate and positioned in an engagement with a housing surrounding an RF receiver or transceiver;

a feedline electrically communicating at a first end with said wideband antenna, and adapted at a second end for electrical communication with said RF receiver or transceiver positioned within said housing;

a planar dielectric substrate positioned in-between said wideband antenna and said RF receiver or transceiver and a thickness thereof defining a minimum spacing therebetween;

said electronic device being a cellular phone;

said dielectric substrate formed of FR-4 and having a said thickness of between 164th of an inch to ⅛th of an inch; and said dielectric substrate having an area equal to or greater than an area of a motherboard of said cellular phone populated with electronic components.

2. An antenna element system of claim 1, additionally comprising:

said dielectric substrate having a thickness of .032 inches.

3. The antenna system of claim 1, wherein said wideband antenna comprises:

a first substrate surface, a portion of which is covered with a conductive material, and a portion of which is uncovered;

said conductive material forming a pair of horns, each of said pair of horns having substantially identical shapes and formed of substantially equal areas of said conductive material;

each of said horns each extending in opposite directions to distal tips;

a first cavity formed by said uncovered portion in-between said pair of horns;

said first cavity having a mouth portion, said mouth portion beginning at a first edge along a line extending between said distal tips;

said mouth portion reducing in cross-section as it extends from said first edge from a widest point substantially in-between said distal tips, to a narrowest point in between said pair of horns;

said first cavity extending away from said narrowest point in a curve and extending into a first one of said horns; and said feedline electrically communicating at a first end with a second one of said horns and configured at a second end for electrical communication with said RF receiver or transceiver.

4. The antenna element of claim 3, further comprising:

said narrowest point being at a position substantially equidistant from both said distal tips; and said position of said narrowest point being substantially along a line running perpendicular to said first edge.

5. An antenna element system for engagement with an electronic device, comprising:

an antenna substrate;

a wideband antenna element formed on a first surface of said antenna substrate and positioned in an engagement with a housing surrounding an RF receiver or transceiver;

a feedline electrically communicating at a first end with said wideband antenna, and adapted at a second end for electrical communication with said RF receiver or transceiver positioned within said housing;

a planar dielectric substrate positioned in-between said wideband antenna and said RF receiver or transceiver and a thickness thereof defining a minimum spacing therebetween;

said electronic device being a cellular phone;

said electronic substrate formed of FR-4 and having a said thickness of between 164th of an inch to ⅛th of an inch;

said first portion of said antenna substrate covered with a conductive material, and a having a portion of which is uncovered;

said conductive material forming a pair of horns, each of said pair of horns having substantially identical shapes and formed if substantially equal areas of said conductive material;

each of said horns each extending in opposite directions to distal tips;

a first cavity formed by said uncovered portion in-between said pair of horns;

said first cavity having a mouth portion, said mouth portion beginning at a first edge along a line extending between said distal tips;

said mouth portion reducing in cross-section as it extends from said first edge from a widest point substantially in-between said distal tips, to a narrowest point in between said pair of horns;

said first cavity extending away from said narrowest point in a curve and extending into a first one of said horns; and said feedline electrically communicating at a first end with a second one of said horns and configured at a second end for electrical communication with said RF receiver or transceiver;

said narrowest point being at a position substantially equidistant from both said distal tips;

said position of said narrowest point being substantially along a line running perpendicular to said first edge;

a pair of "L" shaped conductors extending from a respective one of said horns from a point adjacent to a respective said distal tip of said horns; and each respective said conductor electrically communicating between a respective said distal tip of one said horn and a respective body portion of the same said horn from which it extends.

* * * * *